United States Patent [19]

West

[11] Patent Number: 4,628,167

[45] Date of Patent: Dec. 9, 1986

[54] APPARATUS FOR INDUCTIVELY HARDNEING THE INTERIOR SURFACE OF OBJECTS

[75] Inventor: William D. West, Warren, Mich.

[73] Assignee: Tocco, Inc., Boaz, Ala.

[21] Appl. No.: 749,525

[22] Filed: Jun. 27, 1985

[51] Int. Cl.[4] ..... H05B 6/38

[52] U.S. Cl. ..... 219/10.57; 219/10.49 R; 219/10.43; 219/10.79; 266/123; 266/127; 266/129

[58] Field of Search ..... 219/10.57, 10.49 R, 219/10.67, 10.43, 10.79; 148/145, 146, 150, 152, 154; 266/123, 124, 129, 130, 134, 114, 127

[56] References Cited

U.S. PATENT DOCUMENTS

| | | | |
|---|---|---|---|
| 2,295,272 | 9/1942 | Somes | 148/152 X |
| 2,397,629 | 4/1946 | Stevens | 219/10.79 X |
| 2,528,714 | 11/1950 | Wadhams | 219/10.79 X |
| 2,547,053 | 4/1951 | Somes, Jr. et al. | 148/150 |
| 2,556,243 | 6/1951 | Vaughn | 219/10.79 X |
| 2,752,470 | 6/1956 | Redmond et al. | 219/10.43 |
| 2,756,985 | 7/1956 | Radtke | 266/134 X |
| 2,757,267 | 7/1956 | Brauer et al. | 219/10.79 X |
| 2,797,289 | 6/1957 | Georgen | 219/10.57 |
| 3,378,917 | 4/1968 | Lapham | 219/10.79 X |
| 3,862,348 | 1/1975 | Keller | 219/10.57 X |
| 4,375,997 | 3/1983 | Matz | 148/150 |
| 4,401,485 | 8/1983 | Novorsky | 148/150 |
| 4,531,987 | 7/1985 | Pfaffmann et al. | 148/150 |

*Primary Examiner*—Philip H. Leung

*Attorney, Agent, or Firm*—Body, Vickers & Daniels

[57] ABSTRACT

An induction heating device is provided which can be easily and inexpensively modified to inductively heat and quench harden workpiece bores of various diameters. The device consists of a permanently mounted mandrel and easily interchangeable inductor coil and quench modules which can be easily and rigidly connected to the mandrel.

16 Claims, 7 Drawing Figures

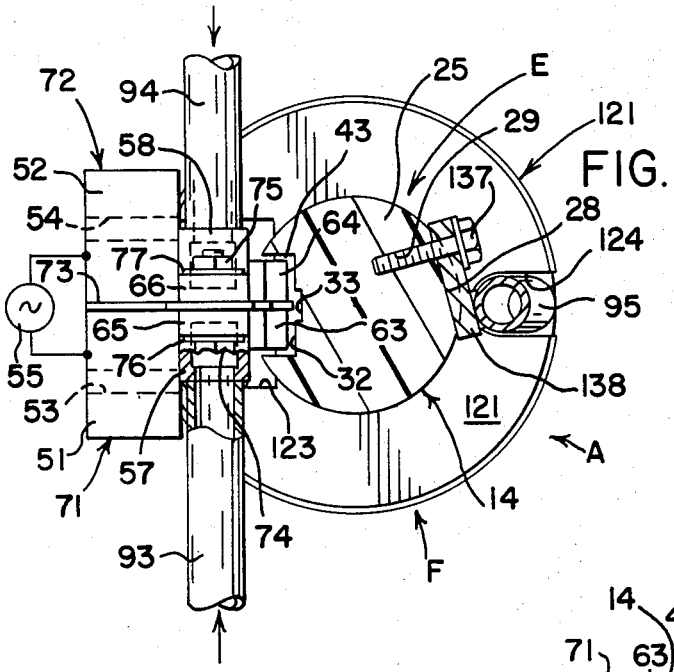
FIG. 3
FIG. 4
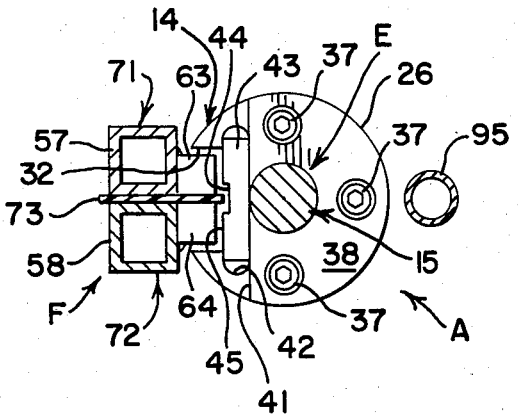
FIG. 5
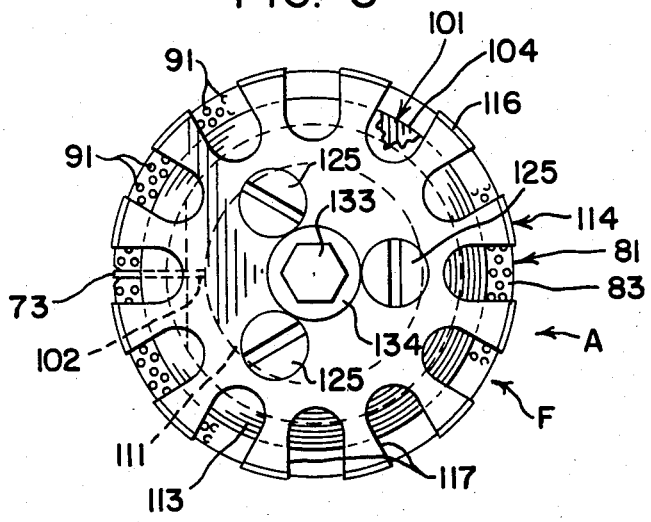

A
27
22
21
17
12
18
25
E
28
29
32
14
33
36
37
42
35
34
39
43
44
26
45
41
38
15
65
76
74
137
93
53
51
138
53
73
63
61
71
57
F
73
95
127
124
121
105
82
81
91
83
104
101
113
115
114
116
117
118
111
133
134

APPARATUS FOR INDUCTIVELY HARDNEING THE INTERIOR SURFACE OF OBJECTS

The present invention relates to the art of induction heating and more particularly to an apparatus utilizing an inductor to heat the interior wall surface of a bore extending into a workpiece.

BACKGROUND OF THE INVENTION

The present invention is particularly applicable to inductively heating and quench hardening cylinder liners used in internal combustion engines or other thin walled workpieces having a constant circular cross section along their axis and will be described with particular reference thereto; however, the invention has broader applications and may be used for heating the interior surface of any bore of generally constant cross-section irrespective of the shape.

It is common practice to harden the inner cylindrical surface of various bores, such as cylinder liners, by using a circular inductor having an outside diameter slightly smaller than the diameter of the inner surface of the liner. The inductor is energized and moved or progressed upwardly along the cylindrical surface to progressively heat the surface by induction. A quenching mechanism is provided which follows below the inductor and directs a quenching liquid outwardly to quench harden the previously heated portions of the cylindrical surface. Often, the workpiece is rotated during this operation to assure a more uniform heating pattern.

Positioning of the inductor in such induction heating processes is important in that a uniform small gap must be maintained between the inductor and the surface being heated to assure uniform induction heating around the entire periphery of the surface.

In the past, the induction heating of cylinder liners for internal combustion engines, i.e. diesel engines, employed induction heating equipment included an inductor assembly having a large, strong, complex, laminate mandrel integrally supporting an inductor coil, a following quench ring assembly, large vertical hollow conductors supplying electrical current and cooling water to the inductor coil and a vertical tube feeding quench fluid to the quench ring assembly. These components were all permanently assembled into a unit. Each element of this inductor assembly or unit was a complex, expensive part, all of which were brazed together. The strength and complexity of the supporting mandrel and the structural integrity of the assembly were required in order to maintain rigidity and proper positioning of the inductor coil and to assure proper induction heating of cylinder liners by maintaining an accurate fixed air gap around the coil.

In the past, such induction heating units were made for a single diameter liner and they could not be segregated into easily separate components which would allow for interchangeability. This was not a problem in high volume dedicated application. Each machine was tailor-made for a given cylinder liner and the development costs were absorbed over the lifetime of the production run. It was believed that each inductor had to be specially designed and tested for a given liner.

With more competition in the equipment field and the introduction of low inventory, versatile manufacturing techniques, such as the "just on time" low inventory technique, into the automotive industry, it has been found that customers cannot or will not purchase a special machine for each size cylinder liners. Versatile manufacturing equipment is in demand. This presents serious problems. To solve this problem I found that I could design a mandrel with a replaceable inductor module and by changing only the inductor module, I could get acceptable results for various sized liners. To do this, I had to invent a positive positioning structure easily, precisely and rigidly interlocking any of several inductor modules of different size to a single mandrel. The positioning structure had to be easily understood and used by machine operators and easily connected to standard supplies of electric power and cooling and quench fluid. More importantly, the positioning structure had to precisely align the inductor coil of any of a number of inductor modules with the center line of the mandrel so that an induction heating machine could be changed to process liners of a different diameter by simply changing the inductor module without redesigning and realigning the entire machine.

The present invention provides a new and improved apparatus for induction heating bores, such as cylinder liners, which apparatus overcomes all of the above referred to problems and others and provides for the induction heating of bores of different diameters without the problems mentioned above.

SUMMARY OF THE INVENTION

In accordance with the invention, a modular inductor assembly is provided comprised of two principal parts: a mandrel which is permanently fixed to induction heating equipment and therefore, permanently aligned with such equipment; and, an interchangeable inductor module comprising an inductor coil, quench means, means supplying electrical current to the inductor coil and means supplying quench fluid to the quench means. The inductor module is releasably fixed to the mandrel. Interchangeable inductor modules quickly mount on the mandrel allowing the induction heating of cylinder liners of different diameters without major changes in the process equipment. A complete rebuilding of the inductor assembly, such as required in the prior art, is not required.

Further in accordance with the present invention, the mandrel is comprised of an intermediate shaft portion and a steel pilot shaft portion having a generally constant cross-sectional shape and a tapered lower end. A downwardly facing surface is provided on the mandrel such that the inductor module is releasably fastenable to the mandrel by slidable engagement over the pilot shaft with an upwardly facing surface engaging the downwardly facing surface on the mandrel. The inductor module is held in precise alignment on the mandrel by engagement with the pilot shaft. The operation of a releasable fastener, such as a machine screw engaging the bottom of the pilot shaft, rigidly holds the mandrel and inductor module in aligned assembly.

Yet further in accordance with the invention, the mandrel is provided with an axial groove slidably receiving the conductors supplying electrical current to the inductor module, thereby rigidly fixing the conductors in place and protecting them from damage.

Still further in accordance with the invention, the intermediate shaft portion of the mandrel is constructed mainly from non-conducting material, and a flux concentrator is fixed in place in the intermediate shaft portion at the top of the steel pilot shaft protecting the pilot shaft from unwanted heating caused by induction from the current in the conductors supplying current to the inductor module.

Further in accordance with the invention, the inductor coil of the inductor module is a hollow single turn inductor coil having adjacent ends, a fluid carrying channel inside the inductor coil and a lower surface having a plurality of fluid releasing apertures passing quenching fluid whereby the workpiece is quench hardened.

Still further in accordance with the invention, the electrical conductors supplying electrical current to the adjacent ends of the inductor coil contain fluid carrying channels supplying quench fluid to the inductor coil.

Yet further in accordance with the invention, a quench fluid tube is provided introducing quench fluid into the inductor coil at a point remote from the coil adjacent ends.

Still further in accordance with the invention, the single turn inductor coil has a substantially constant cross-sectional shape over the entire length of the single turn, the cross sectional shape including a horizontal top segment, a vertical inner segment, a vertical outer segment, a horizontal bottom segment, and an outwardly and downwardly facing segment containing the quench apertures; and, the coil is surrounded by a flux intensifier constructed of a lower annular flux intensifier having a L-shaped cross section disposed below and inside the coil and an upper annular flux intensifier disposed above the coil.

The principal object of the invention is to provide an apparatus for heating the internal surface of bores which can be altered to heat the interior surface of bores of different diameters quickly and economically.

Another object of the invention is the provision of an induction heating assembly in which an alignment portion of the assembly can be permanently fixed to process equipment and induction heating and quenching equipment can be easily interchanged on the alignment portion of the equipment without the need for realigning the equipment.

Yet another object of the invention is the provision of a mandrel of great strength and rigidity which will remain in alignment with other process equipment and slidably align an inductor module easily and quickly with remaining process equipment.

Still another object of the invention is the provision of an inductor module which is easily and rigidly connected to a mandrel and which contains a hollow conductor coil which also supplies quench fluid to quench apertures.

A still further object of the invention is the provision of an induction heating assembly which is less expensive to manufacture and maintain than previous induction heating assemblies of the same type; which is more easily modified to heat treat bores of different diameters or shapes than previous induction heating assemblies of a similar type and, which gives induction heating equipment users greater tooling versatility and improved product quality while reducing the costs of an inductor.

These and other objects and advantages of the invention will become apparent from the following detailed description of the preferred embodiment thereof illustrated in the accompanying drawings which form a part hereof.

BRIEF DESCRIPTION OF THE DRAWINGS

FIG. 3 is a horizontal sectional view on line 3—3 of FIG. 2 showing the intermediate shaft portion of the mandrel, the conductors supplying electric current to the inductor coil, quench fluid supply means and the relationship between these elements;

FIG. 4 is a horizontal sectional view taken along line 4—4 of FIG. 2 showing the relationship between the current supply conductors and the inductor coil, the top of the pilot shaft portion of the mandrel and the flux concentrator protecting the top of the pilot shaft;

FIG. 5 is a horizontal upwardly looking view of the bottom of the assembled inductor assembly;

DESCRIPTION OF THE PREFERRED EMBODIMENT

Figure 1:
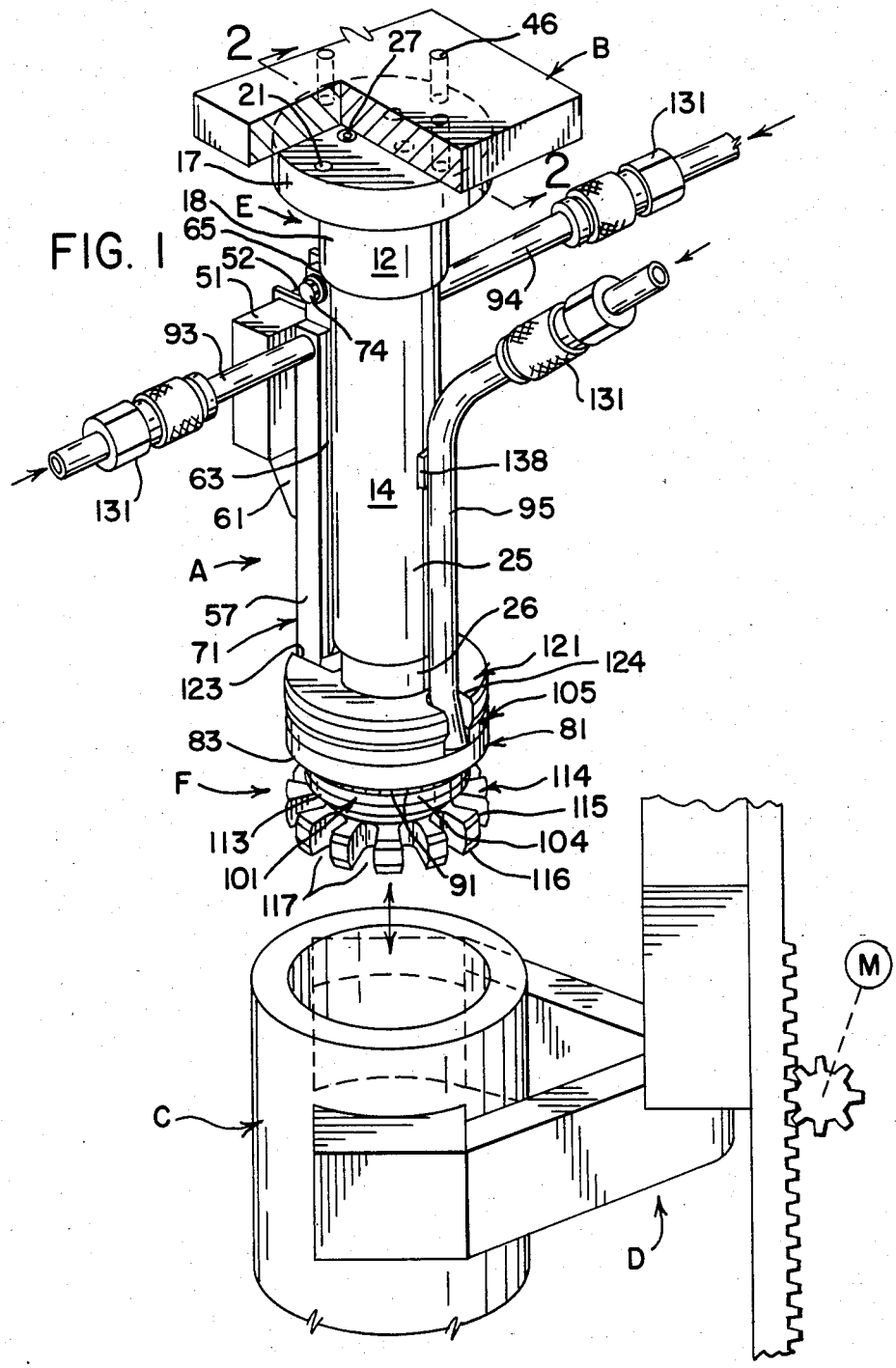
FIG. 1 is a descriptive view showing the inductor assembly in the assembled condition above a workpiece to be hardened.

Referring now to the drawings wherein the showings are for the purpose of illustrating the preferred embodiment of the invention only and not for the purpose of limiting the same, there is shown, in FIG. 1, an inductor assembly A fixed to a support plate B above a workpiece C such as a cylinder liner. The workpiece C is held in place by a workpiece locating mechanism D which precisely locates the workpiece and moves it into engagement with the inductor assembly A in a controlled manner.

The process equipment, of which the inductor assembly support plate B and the workpiece locating mechanism D form a part, is conventional and well known in the art. Such equipment engages a workpiece, moves the workpiece into alignment with the inductor assembly A, moves either the inductor assembly or the workpiece such that the inductor assembly passes through the workpiece and hardens the interior surface of the workpiece, and disengages the workpiece. This process equipment forms no part of the present invention.

Figure 6:
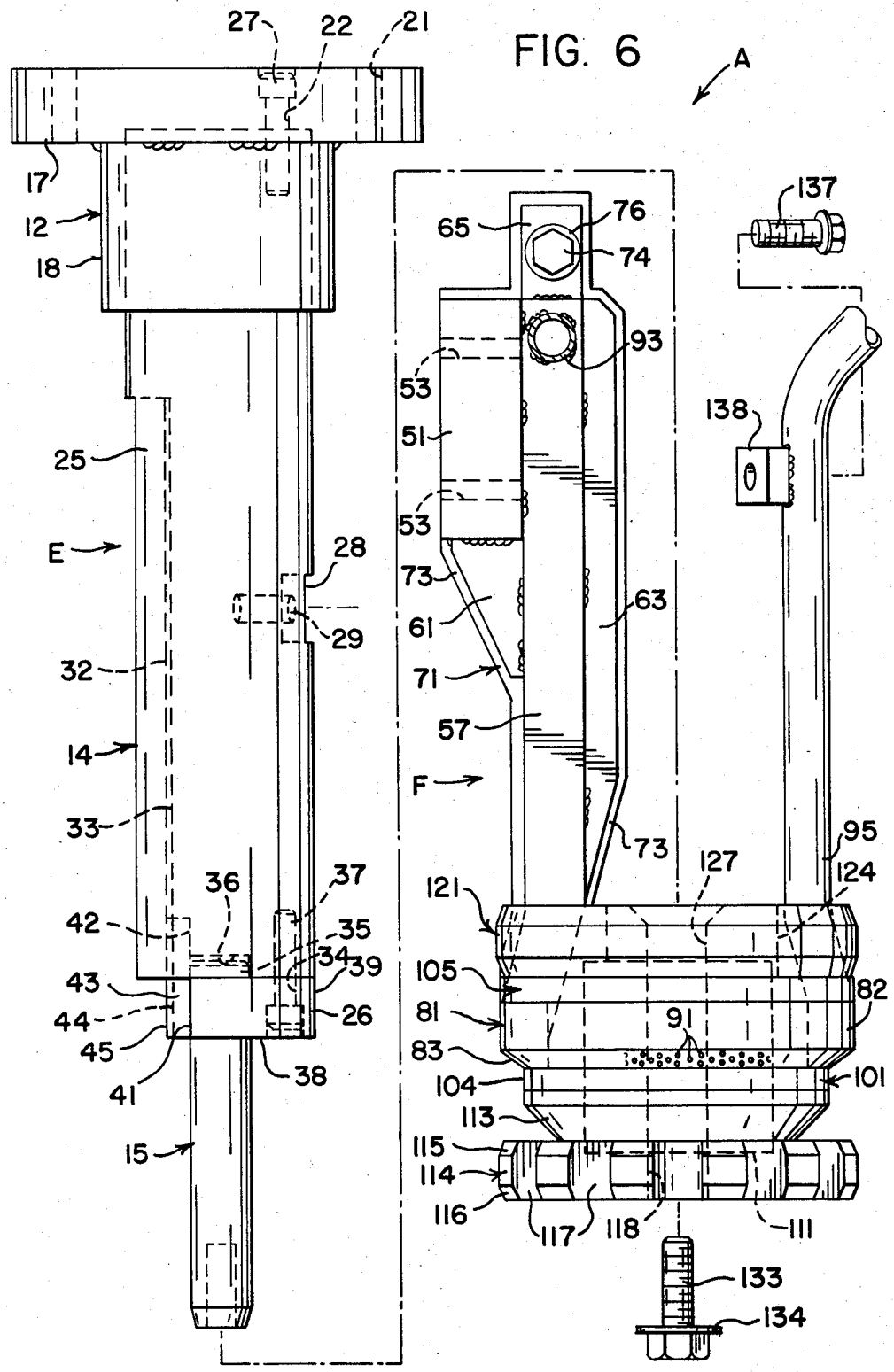
FIG. 6 is an elevational view of the mandrel subassembly and the inductor module prior to final assembly.

As can best be seen in FIG. 6, the inductor assembly A is comprised of two major components, the mandrel E and the inductor module F.

Mandrel E has a mounting base 12 disposed at the top of the mandrel, an intermediate shaft portion 14 and a pilot shaft portion 15 below the intermediate shaft portion. These elements are shown in exploded view in FIG. 7. Mounting base 12 is metallic and comprised of a mounting disk 17 and a mounting annulus 18. Mounting disk 17 is provided with four outer screw holes 21 used to mount the mounting base to support plate B. Mounting disk 17 is also provided with three inner screw holes 22 which open to the interior of the annulus 18.

The intermediate shaft portion 14 is comprised of an upper intermediate shaft portion 25 and a lower intermediate shaft portion 26. The upper intermediate shaft portion 25 is generally cylindrical and fabricated from an insulating material such as laminated glass reinforced plastic. The upper intermediate shaft portion 25 has an outside diameter slightly smaller than the interior diameter of annulus 18 and fits inside this annulus. Three machine screws 27 pass through the inner screw holes 22 in mounting disk 17 and firmly fix the upper intermediate shaft portion 25 in place. The combination of the engagement between the upper intermediate shaft portion 25 and the inner surface of the annulus 18 and the three machine screws 27 supply a very rigid interconnection between the intermediate shaft portion 14 and the mounting base 12. The upper intermediate shaft portion 25 is sufficiently long such that the inductor module F, when mounted on the mandrel E, is capable of fully penetrating the longest workpiece desired to be hardened. Thus, the inductor assembly A may harden the entire inner surface of a workpiece or any selected portion thereof.

The upper intermediate shaft portion 25 has a small flat portion 28 and a screw hole 29 cut into it at a position substantially above the bottom of the intermediate shaft portion 14. Generally opposite to this flat portion 28 and screw hole 29 is a large rectangular groove 32 extending from the bottom of the upper intermediate shaft portion 25 axially up the intermediate shaft portion 14 to a point near the top of the upper intermediate shaft portion 25. A small rectangular groove 33 is cut into the upper intermediate shaft portion in the center of the bottom of the large rectangular groove 32 and extends for the full length of the large rectangular groove 32.

The lower intermediate shaft portion 26 and the pilot shaft portion 15 form a unitary structure and are, in fact, machined from a single piece of stainless steel. Of course, should it be desirable, the pilot shaft 15 and the lower intermediate shaft portion 26 can be fabricated from separate pieces of material and pressed together or fastened together in some other manner.

The lower intermediate shaft portion 26 is provided with three screw holes 34 and an alignment button 35 directly above pilot shaft portion 15. The alignment button 35 engages an alignment recess 36 in the bottom surface of the upper intermediate shaft portion 25. Three machine screws 37 pass through the screw holes 34 and fasten the lower intermediate shaft portion 26 and pilot shaft portion 15 rigidly to the upper intermediate shaft portion 25. A very rigid mandrel E results.

The lower intermediate shaft portion 26 has the shape of a chord truncated cylinder. Thus, the lower intermediate shaft portion 26 has a flat top surface on which the alignment button 35 is disposed, a flat bottom surface 38 from which the pilot shaft portion 15, depends, a curved side surface 39 aligned with the side surface of the upper intermediate shaft portion 25, and a flat side surface 41. The flat side surface 41 is aligned with the large rectangular groove 32 in the upper intermediate shaft portion 25.

A magnetically permeable rectangular flux concentrator 43 is cemented into a recess 42 at the bottom of the upper intermediate shaft portion 25 and extends downwardly, overlaying the flat side 41 of lower intermediate shaft portion 26. The rectangular flux concentrator 43 has an outwardly facing flat surface 45 with a small rectangular groove 44. The outwardly facing flat surface 45 is aligned with the bottom of the large groove 32 in the upper intermediate shaft portion 25 and forms a continuation of this surface for the full length of the lower intermediate shaft portion 26.

The rectangular flux concentrator 43 is fabricated from commercially available magnetic material such as ferrocon.

The assembled mandrel E is a rigid, tough structure and is permanently attached to support plate B by several machine screws 46. Once mounted and aligned, this rigid structure will maintain its alignment.

Figure 2:
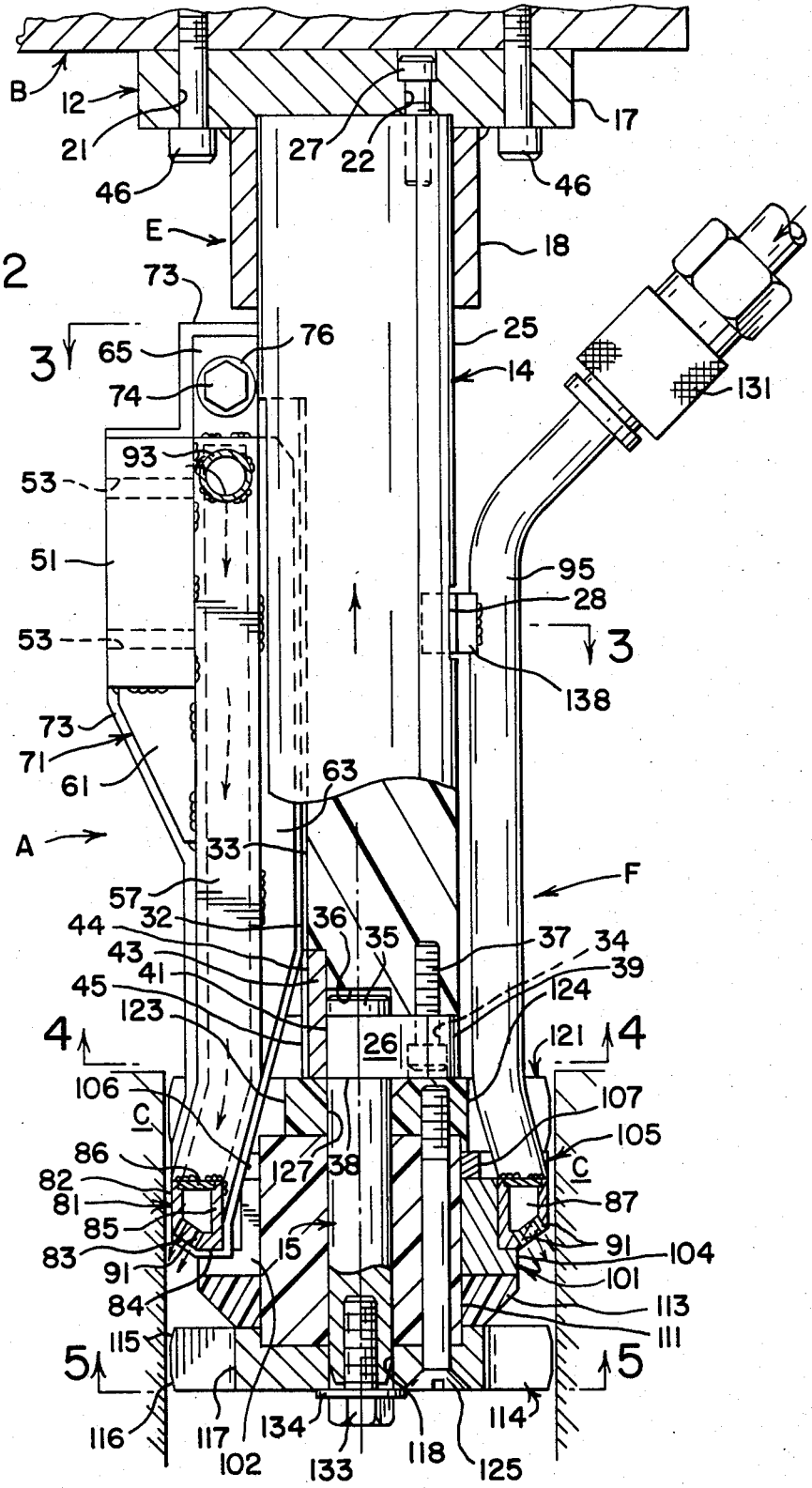
FIG. 2 is an elevational view, partially in section, on the line 2—2 of FIG. 1.
Figure 7:
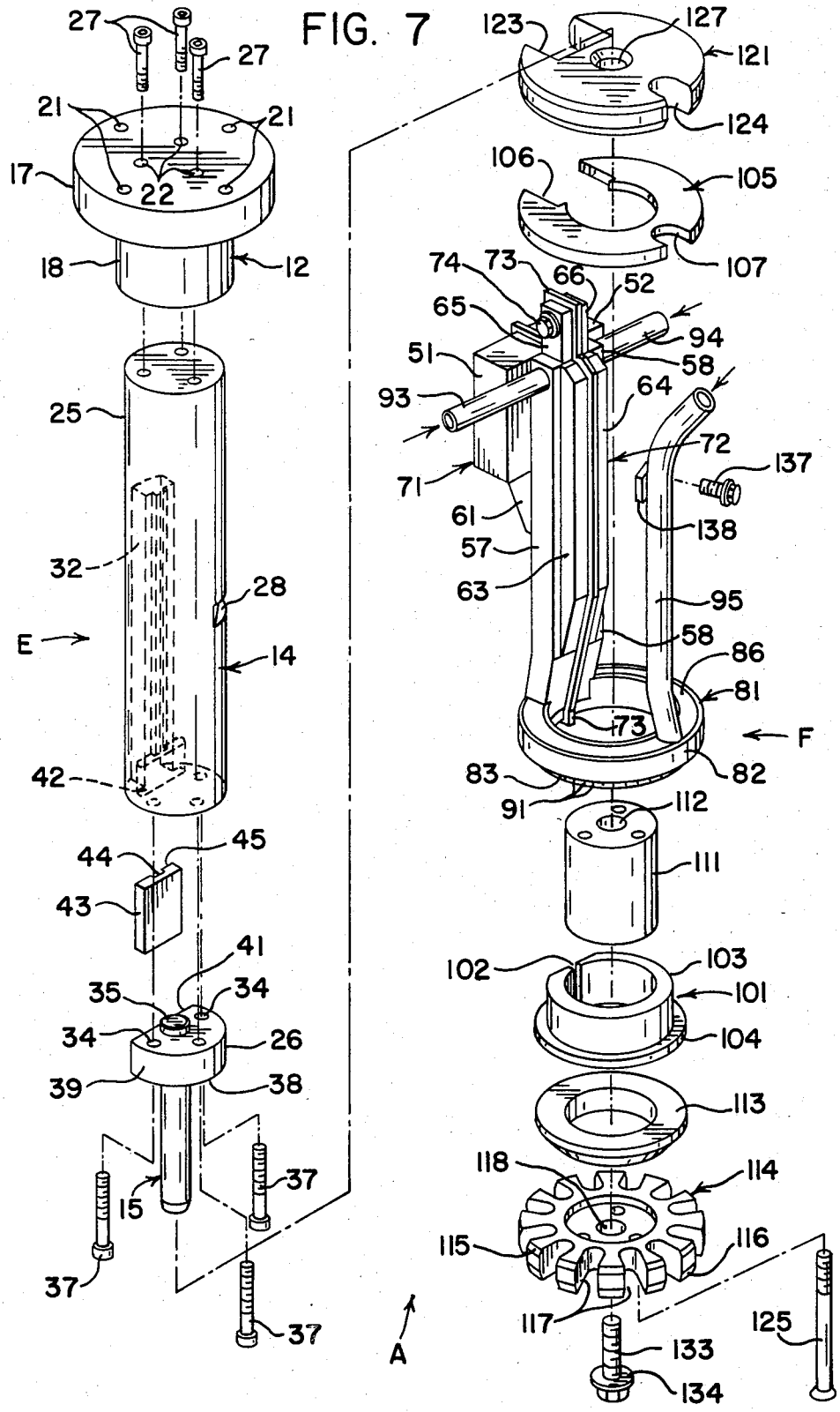
FIG. 7 is an exploded view of the disassembled mandrel and the disassembled inductor module.

The inductor module F is shown on the right side of FIGS. 6 and 7 and, in FIG. 2, is shown mounted on the mandrel E to form the inductor assembly A. Two copper electrical contact blocks 51, 52 are machined from solid copper stock and drilled and tapped to provide two pairs of contact holes 53, 54. An electrical power source 55, shown schematically, is connected to these electrical contact blocks by fastening on heavy connectors. In the preferred embodiment, inserts are placed in the contact holes 53, 54 so that sufficient torque may be applied to the fasteners to assure good electrical conduction along the joint.

Each electrical contact block 51, 52 is brazed to a hollow rectangular electrical supply conductor 57, 58. Two identical copper triangular support blocks, only one of which is shown, 61 are brazed to the two electrical supply conductors 57, 58 and to the electrical contacts blocks 51, 52. On the side of the electrical supply conductor opposite the electrical contact blocks and triangular support blocks, two solid copper bars 63, 64 are provided. One bar is brazed to each of the conductors 57, 58. The two solid copper bars 63, 64 extend for almost the full length of the electrical supply conductors, providing additional current carrying capacity and stiffening the conductors. Two tabs 65, 66 are brazed to the tops of the electrical conductors 57, 58 and the remaining portion of the top of each conductor is closed.

The two electrical supply conductors 57, 58 and their associated contact blocks, triangular support blocks, bars and tabs form conductor assemblies 71, 72 which are electrically separated from one another by a flat insulator 73 disposed between the two conductor assemblies. The two conductor assemblies 71, 72 are held in closely spaced parallel relationship by a machine screw 74 and nut 75 passing through holes in the tabs 65, 66 and a similarly positioned hole in insulator 73. Two insulating bushings 76, 77 isolate the machine screw 74 and the nut 75 from the copper tabs 65, 66 and maintain electrical isolation between the two conductor assemblies at this point.

The lower extremities of the two conductors 57, 58 are brazed to the ends of a single turn inductor coil 81. The inductor coil 81 has a substantially constant cross-sectional shape around the entire turn. The cross-sectional shape of the inductor coil includes an outer vertical section 82, an oblique downwardly outwardly facing segment 83, a bottom horizontal segment 84, an inner vertical segment 85 and a top horizontal segment 86. The portion of the inductor coil comprising the outer vertical segment 82, the downwardly outwardly facing segment 83, the bottom horizontal segment 84 and the inner vertical segment 85 are formed from a single piece of copper into a slotted, circular form having a generally U-shaped cross-section with an internal channel 87. The top horizontal segment 86 of the inductor coil 81 is formed of a generally annular shaped slotted piece of copper which is brazed into the top of the U-shaped portion of the inductor coil 81.

As can best be seen in FIG. 7, electrical supply conductor 57 is brazed to one end of inductor coil 81 and electrical supply conductor 58 is brazed to the other end of inductor coil 81 and the two proximate ends of the inductor coil 81 are separated from one another by the insulator 73 extending along the full length of the two electrical supply conductors 57 and 58. Thus, a complete electrical circuit is provided with current flowing from power supply 55 through electrical contact block 51, electrical supply conductor 57, single turn inductor coil 81, electrical supply conductor 58, electrical contact block 52 and back to the power supply.

The downwardly outwardly facing segment 83 of inductor coil 81 is provided with a large number of small quench holes 91. Quench fluid is supplied through two tubes 93, 94 brazed to two apertures near the tops of electrical supply conductors 57, 58. The quench fluid flows through tubes 93, 94, the hollow electrical supply conductors 57, 58 and hence downwardly and into the internal channel 87 of inductor coil 81. Additional quench fluid flows through additional quench tube 95 which is brazed to an aperture in the top horizontal segment 86 of inductor coil 81 at a point on the inductor coil 81 opposite the electrical supply conductors 57, 58.

Three identical quick disconnect couplings 131 are provided at the ends of tubes 93, 94 and additional quench tube 95.

The quench fluid flows through the internal channel 87 in inductor coil 81 and out quench holes 91 which direct the fluid downwardly and outwardly such that it will impinge against the surface of the workpiece C below the inductor coil 81.

Disposed within and below the inductor coil 81 is a lower flux intensifier 101. The lower flux intensifier 101 has an L-shaped cross section and is slotted with a slot penetrating completely through the flux intensifier. The slot 102 is positioned to coincide with the gap between the ends of the inductor 81. The vertical portion 103 of the lower flux intesifier 101 is of a height equal to the height of the inductor coil inner vertical segment 85 and lays against this surface. The horizontal portion 104 of the lower flux intensifier 101 is of a length equal to that of the inductor coil bottom horizontal segment 84 of the inductor coil 81 and lays against this surface.

An upper flux intensifier 105 is annular in shape and slotted with a large slot 106 completely through the flux intensifier. The upper flux intensifier 105 is positioned directly above inductor coil 81 and overlays the entire top horizontal segment 86 of the inductor coil 81. The upper flux intensifier slot 106 accommodates the passage of the electrical supply conductors 57, 58 upwardly from the inductor coil 81. A second slot 107 penetrates partially through the upper flux intensifier and accommodates passage of the additional quench tube 95 upwardly from the inductor coil 81.

The lower flux intensifier 101 and the upper flux intensifier 105 together have a C-shaped cross section which partially surrounds the inductor coil 81.

A cylindrical insulating spacer 111 having an axial bore 112 therethrough, is disposed within the upper and lower flux intensifiers 105, 101. An insulating spacer ring 113 is disposed below the lower flux intensifier 101 and about spacer 111. A lower scuff ring 114 is disposed directly below spacer ring 113. The lower scuff ring 114 is fabricated from brass or stainless steel and has an outside diameter slightly greater than the outside diameter of the inductor coil 81. The lower scuff ring 114 has beveled upper and lower edges 115, 116 and a plurality of large slots 117 in its outer periphery. The lower scuff ring also has an axial bore 118 sized to accommodate the pilot shaft portion 15.

An insulating upper scuff ring 121 having an axial bore 127, a slot 123 to accommodate the electrical supply conductors 57 and 58 and a small slot 124 to accommodate the additional quench fluid tube 95 is disposed directly above the upper flux intensifier 105.

Three machine screws 125 pass through the lower scuff ring 114, the cylindrical spacer 111 and engage the upper scuff ring 121. These machine screws hold these elements rigidly together and also tightly position the spacer ring 113, and the lower flux intensifier 101, the inductor coil 81 and the upper flux intensifier 105 around spacer 111. A complete inductor module F, as shown in the right hand portion of FIG. 6, is thus provided.

The inductor module F is comprised of copper conducting elements and quench fluid conveying elements; magnetically permeable flux intensifier elements; and insulating spacers and scuff rings. While the inductor module is robust, it is not provided with a machined rigidifying mandrel such as in prior art induction heating heads for similar uses and is therefore significantly less expensive to manufacture than prior art units.

The inductor module as shown in FIG. 6 is easily mounted on the mandrel E as shown in FIG. 6 to form the inductor assembly A as shown in FIG. 2. The inductor module F is slid onto mandrel E with the inner portions of the solid copper bars 63 and 64 and the insulator 73 engaging and sliding in the grooves 32, 33 and 44. The pilot shaft portion 15 of the mandrel E penetrates through the axial bores of the upper scuff ring 121, the insulating spacer 111, and the lower scuff ring 114.

A machine screw 133 is threaded through a washer 134 and into the bottom of pilot shaft portion 15 and engages the bottom of lower scuff rings 114. The machine screw surface of upper scuff ring 121 engages the bottom surface 38 of the lower intermediate shaft portion 26, firmly holding the inductor module F on the mandrel E.

A machine screw 137 passes through a tab 138 fixed to the additional quench fluid tube 95 and into screw hole 29 in the flat portion 28 of the mandrel upper intermediate shaft portion 25. Thus, the additional quench fluid tube 95 is firmly held in place by screw 137; the conductor assemblies 71, 72 are held in place by the grooves 32, 33; and, the inductor coil 81 is firmly fixed in place and aligned by the passage of pilot shaft 15 through the axial apertures of scuff rings 121, 114 and the insulating spacer 111. Quench fluid is supplied through the quick disconnects 131 and tubes 93, 94 and 95. Electrical current is supplied through the bolted connection at the electrical contact blocks 51, 52. The inductor assembly A is ready for use.

As seen in FIG. 2, the inductor assembly A operates by first penetrating through the interior bore of a cylinder liner or like workpiece C, either to its bottom or to a preselected point at which induction hardening is to begin. Quench fluid is supplied through the tubes 93, 94, 95 and the inductor assembly is then energized. The inductor assembly A is moved upwardly or the workpiece C is moved downwardly and rotated at a preselected rate. The workpiece is heated on an advancing front by the inductor coil 81, and immediately following this heating, quenched by fluid passing through quench holes 91. A hardened surface results.

When it becomes desirable to inductively heat bores of a different diameter, the power supply 55 is disconnected from electrical contact blocks 51, 52: the three quick disconnect couplings 131 are disengaged, and machine screws 137, 133 are removed. Inductor module F is then simply slid off the mandrel E. An inductor module having a diameter or configuration to inductively heat the bore shape and size in the new workpiece, but otherwise identical to sub-assembly F, is mounted on the mandrel. The new inductor coil 81 is properly aligned by its placement on pilot shaft portion 15 and firmly held in place ready for immediate use.

The invention has been described with reference to a preferred embodiment. Obviously, modifications and alterations will occur to others upon the reading and understanding of this specification. It is my intention to include all such modifications and alterations insofar as they come within the scope of the appended claims or the equivalents thereof.

Having thus described my invention, I claim:

1. An inductor and quench head apparatus for heat treating elongated bores of substantially uniform cross-sectional shape comprising:

a mandrel including a mounting base, an intermediate shaft portion, a downwardly facing surface and a pilot shaft portion of substantially constant cross-sectional shape;

an inductor module comprising:

an inductor coil, means supplying electrical current to said inductor coil, quench means dispensing quench fluid near said inductor coil and means supplying fluid to said quench means, said inductor module having a central aperture slightly larger in cross-section than said pilot shaft portion and an upwardly facing surface;

said inductor module being releasably fixed to said mandrel by a first fastener means with said central aperture engaging said pilot shaft, and said upwardly facing surface engaging said downwardly facing surface.

2. The apparatus of claim 1 wherein said pilot shaft portion is steel and said first fastener means is a threaded fastener engaging a threaded aperture in said pilot shaft.

3. The apparatus of claim 1 wherein said intermediate shaft portion is comprised of an electrically non-conducting upper portion and a steel lower portion; and, said pilot shaft portion and said lower intermediate shaft portion are a unitary steel structure.

4. The apparatus of claim 3 wherein said intermediate shaft portion is provided with a groove extending axially along a selected portion of said intermediate shaft portion, said groove adapted to slidably receive said means supplying electrical current to said inductor coil.

5. The apparatus of claim 4 wherein said mandrel has a flux concentrator fixed in place near the bottom of said intermediate shaft portion groove.

6. The apparatus of claim 3 wherein said intermediate shaft portion is generally cylindrical, said lower intermediate shaft portion has a flattened portion, and said mandrel is provided with a flux intensifier fixed to said lower intermediate shaft flattened portion.

7. The apparatus of claim 1 wherein said inductor coil contains a fluid carrying channel and said quench means comprises a lower surface of said inductor coil having a plurality of quench apertures extending to said fluid carrying channel dispensing quench fluid to the area below said inductor coil.

8. The apparatus of claim 7 wherein said means supplying electrical current to said inductor coil are two hollow metallic conductors and said means supplying quench fluid comprises fluid carrying channels in said conductors.

9. The apparatus of claim 8 wherein said inductor coil is a single turn coil having two adjacent ends, said two hollow metallic conductors are rigid conductors extending vertically from said coil ends and said means supplying quench fluid additionally comprises a quench fluid tube introducing fluid into said coil at a point remote from said coil ends, said quench fluid tube being releasably fixed to said mandrel intermediate shaft portion.

10. The apparatus of claim 8 wherein said two hollow metallic conductors are rigid conductors extending vertically from said inductor coil in closely spaced parallel relationship, said conductors each having a metallic bar fixed to one side of said conductor over a substantial portion of its length, said bars being slidably received in a groove on said mandrel intermediate shaft portion.

11. The apparatus of claim 7 wherein said inductor coil is a single turn coil having a substantially constant cross-sectional shape over the entire length of the single turn, said coil cross-sectional shape including an obliquely outwardly and downwardly facing segment, said quench apertures being in said obliquely facing segment.

12. The apparatus of claim 11 wherein said coil cross-sectional shape comprises said obliquely facing surface, a top horizontal surface and an outer vertical surface; and, said inductor module additionally comprises a coil flux intensifier assembly comprising a first annular flux intesifier having a L-shaped cross-sectional shape disposed within and below said inductor coil and a second annular flux intensifier disposed above said inductor coil.

13. An inductor and quench head for heat treating elongated bores of substantially uniform cross-sectional shape comprising:

a mounting base;

a mandrel;

a fluid carrying, hollow single turn inductor coil having two ends proximate to one another, a generally constant cross-sectional shape comprising a top horizontal segment, an inner vertical segment, a bottom horizontal segment, an outer vertical segment and an obliquely downwardly and outwardly facing segment, and a plurality of fluid passing apertures in said obliquely downwardly and outwardly facing surface;

a flux intensifier assembly comprised of a first annular flux intensifier having an L-shaped cross-sectional shape disposed within and below said inductor coil engaging said inductor inner vertical segment and bottom horizontal segment and a second annular flux intensifier disposed above said inductor coil engaging said inductor top horizontal segment whereby said flux intensifier assembly has a C-shaped cross-section and engages substantially all of said inductor coil except said outer vertical segment and said obliquely downwardly and outwardly facing segment; and, rigid conductors supplying electrical current to said inductor coil having quench fluid channels carrying quench fluid to said inductor coil disposed therein.

14. An inductor module adapted to be mounted on a mandrel comprising:

a hollow single turn inductor coil generally contained in a single plane having a downwardly facing surface;

at least two rigid electrical supply conductors providing electrical current to said coil, said conductors being disposed perpendicularly to the plane of said coil, parallel to one another and in close proximity to one another;

a flux intensifier disposed over, under and within said coil;

an upper scuff ring having a central aperture disposed above said coil;

a lower scuff ring having a central aperture disposed below said coil;

a spacer having a central aperture disposed between said upper scuff ring and said lower scuff ring and within said coil; and, fastening means fixing said upper scuff ring, said lower scuff ring, said coil, said flux intensifier and said spacer rigidly together with said upper scuff ring central aperture, said lower scuff ring central aperture and said spacer central aperture in aligned relationship.

15. The inductor module of claim 14 wherein said inductor coil is provided with a fluid passage therein allowing fluid to circulate through said coil and a downwardly outwardly facing surface having a plurality of apertures therein allowing the passage of fluid from said coil fluid passage to the exterior of said coil; and, said rigid electrical supply conductors are provided with fluid passages supplying fluid to said coil.

16. The inductor module of claim 15 additionally comprising an additional quench fluid tube supplying fluid to said coil fluid passage at a point remote from said rigid electrical supply conductors.

* * * * *